United States Patent [19]

Neno

[11] 4,138,311

[45] Feb. 6, 1979

[54] METHOD AND APPARATUS FOR BATCH PRODUCTION OF PULP INCLUDING IMPROVED ENERGY RECLAMATION

[75] Inventor: Gervais S. Neno, Mobile, Ala.

[73] Assignee: International Paper Company, New York, N.Y.

[21] Appl. No.: 767,574

[22] Filed: Feb. 10, 1977

[51] Int. Cl.[2] ..... D21C 7/08

[52] U.S. Cl. ..... 162/28; 162/47; 162/52; 162/51; 162/234; 162/239; 162/246

[58] Field of Search ..... 162/234, 246, 15, 47, 162/52, 239, 241, 28

[56] References Cited

U.S. PATENT DOCUMENTS

| | | | |
|---|---|---|---|
| 2,029,360 | 2/1936 | Dean | 162/239 |
| 2,115,835 | 5/1938 | Young | 162/51 |
| 2,870,009 | 1/1959 | Richter | 162/52 |
| 3,432,382 | 3/1969 | Justus | 162/246 |
| 3,567,573 | 3/1971 | Case | 162/52 |
| 4,002,528 | 1/1977 | Laakso | 162/19 |

*Primary Examiner*—S. Leon Bashore
*Assistant Examiner*—William F. Smith
*Attorney, Agent, or Firm*—Fitch, Even, Tabin & Luedeka

[57] ABSTRACT

Cooked pulp at an elevated temperature and pressure is discharged from a plurality of batch digesters sequentially into a first blow tank. The first blow tank is maintained at a substantially constant pressure which is less than the pressure in the digester and greater than atmospheric. Pressurized steam is released from the first blow tank into a dirty steam system as pulp is discharged into a second blow tank at a substantially constant rate in a non-interrupted flow stream. The pressure in the second blow tank is maintained at about atmospheric pressure. A blow line refiner is interposed between the first and second blow tanks.

8 Claims, 1 Drawing Figure

Figure 1:
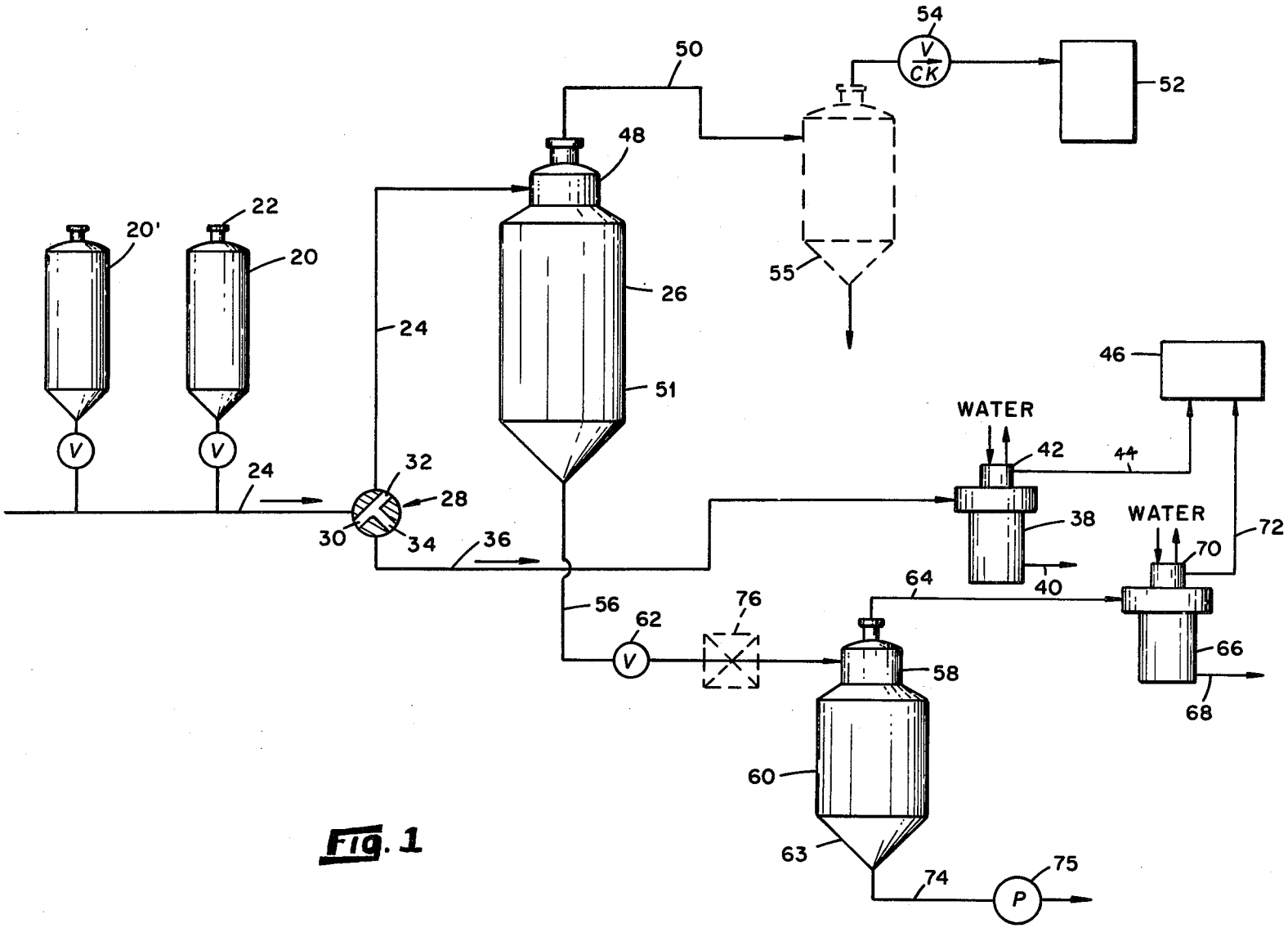

METHOD AND APPARATUS FOR BATCH PRODUCTION OF PULP INCLUDING IMPROVED ENERGY RECLAMATION

The present invention relates generally to improvements in the batch production of fibrous, e.g. wood, pulps and more specifically to an improved method and apparatus for the extraction of pressurized steam from a pulp blow for further use within the pulping process.

In the pulping process, wood chips, water and a variety of chemicals are loaded into a digester which is then sealed. The internal temperature and pressure within the digester are then raised, usually by admitting steam to the digester, to cook the chips. Among other things, cooking dissolves the lignin which binds the fibers together and extracts various compounds present in the wood. The combination of water, chemicals, extracted lignin and other materials is commonly called "black liquor." During the cooking step, steam and various other vapors are produced so that when the cooking step in the batch digester is completed, the internal pressure is generally about 110 psig and the temperature is about 140° C. Using the prior art batch systems, after cooking, the pressurized contents are rapidly forced from the bottom of the digester by the pressurized gases above the pulp mixture, through a conduit called a blow line, and into a blow tank at atmospheric pressure. Among other results the blowing effect created by the sudden changes in volume and pressure tends to physically break up the fiber bundles. Importantly, large amounts of steam are released during a "blow."

With increasing concern for air pollution, improved methods and apparatus to minimize the amount of vapors escaping from the pulping process into the atmosphere are desirable. Heretofore it has been common practice in a blow to condense the steam and other vapors to the greatest extent possible. Uncondensible gases are usually burned. This method is rather expensive because of the necessary effort to remove substantially all of the steam and vapors. This is a problem particularly in batch systems because large amounts of vapors are released over short periods of time. Large capacity equipment is thus required, although it is idle much of the time by reason of the batch nature of the process.

Further, current cost and availability of energy dictate energy reclamation where possible. In present pulping processes, substantial amounts of energy are added to the system to produce heat and pressure. It is, therefore, desirable to recapture and reuse energy (usually in the form of steam) to the maximum extent possible. As previously noted, in most prior art systems the pulp is released from the pressurized digester to atmospheric pressure. The steam at atmospheric pressure contains substantially less energy than pressurized steam and so has a limited number of uses. In some instances, it is utilized in auxiliary portions of the pulping process, e.g. to heat water for the pulping system. This steam (energy) recovery attempt is relatively inefficient because a significant amount of unrecoverable energy is lost in the pressure drop associated with a blow.

There are, however, a variety of uses in a pulping process for steam, even dirty steam, at a moderately elevated pressure, e.g. 40 to 60 psig. ("Dirty" steam is that steam which contains vapors produced by the cooking process, including, for example, terpenes and hydrogen sulfide.) Examples of such uses include preheating chips, heating evaporators, heating stock in a bleach plant, etc. These uses require more energy than is available from steam at atmospheric pressure.

In the field of pulping, both batch and continuous processes are currently in use. A step in the pulping process which has recently proved quite beneficial is blow line refining, which can improve the yield of a particular process by about 5%. In this operation, the pressurized pulp passes through a refiner, typically a disc refiner, on its way from the digester to the blow tank. These refiners break up fiber bundles and work quite well in continuous pulping processes, but encounter problems with batch processes. A blow line refiner requires a relatively constant flow of pulp. Yet batch digester production of pulp is intermittent by nature, even if several digesters discharge into the same blow line. (Batch digesters commonly require about four hours to load and cook the chips, but only about fifteen minutes to discharge.) Therefore, application of blow line refining has heretofore generally been limited to continuous pulping systems.

It is therefore an object of the present invention to provide an improved method and apparatus for processing cooked pulp by the batch method. It is another object to provide for improved recovery of steam from a batch digester. It is another object to provide a method and apparatus for conducting blow line refining of a pulp mixture generated by a batch digester.

Various other objects and advantages of the invention will become apparent by reference to the accompanying description, including the drawing in which:

FIG. 1 is a schematic diagram of a batch pulping system embodying various features of the invention.

In the disclosed method a batch of cooked pulp is discharged from a digester to a first blow tank, the internal pressure of which tank is maintained substantially higher than atmospheric. Pressurized steam and other vapors are controllably removed from this first blow tank while simultaneously the pulp mixture is controllably discharged to a second blow tank maintained at approximately atmospheric pressure. Steam and other vapors are removed from the second blow tank while the pulp is removed for further processing. In one embodiment, the pulp is passed from the first blow tank through a blow line refiner, thence to the second blow tank.

Referring to FIG. 1, the apparatus schematically represented includes one or more digesters 20 and 20', each including a top opening 22 for loading the digester. (In most batch pulping plants several digesters are used and discharged alternately.) The digester 20 is connected by a first blow line 24 to the top portion of a first blow tank 26. A valve means 28 having an inlet 30, a first outlet 32, and a second outlet 34 is interposed in the blow line 24 between the digester 20 and the blow tank 26. The first and second outlets 32 and 34, respectively, are mutually exclusive, the first outlet 32 leading to the first blow tank 26. The second valve outlet 34 is preferably connected by a vent conduit 36 to a water-cooled condenser 38. A bottom drain 40 in the condenser provides means for withdrawing condensate from the condenser, with noncondensibles being discharged from the top 42 of the condenser and fed through a conduit 44 to an odor control system 46 such as a flame. The discharged cooling water, which absorbs the latent heat of the condensed material is used within the pulping process.

The top portion 48 of the pressurized first blow tank 26 is connected by a conduit 50 in flow communication with a "dirty" steam system 52 which uses partially cleaned pressurized steam for various purposes in the pulping process. A pressure regulating valve 54 is interposed in the conduit 50 between the blow tank 26 and the dirty steam system 52 to control the release of steam from the blow tank 26 and maintain a constant elevated pressure within the first blow tank, preferably about 40 psig. In one embodiment, the top portion 48 of the blow tank 26 comprises a vortex separator of conventional design such that suspended liquid and pulp particles are separated from the steam and other vapors prior to entry of the vapors into the conduit 50. The fibrous and other solids and the black liquor drop to the bottom portion 51 of the blow tank as the steam exits through conduit 50. As desired, a liquid separator 55 is interposed in the conduit 50 between the first blow tank 26 and the valve 54 to provide for additional extraction of liquid from the steam.

The bottom portion 51 of the blow tank 26 is connected by a second blow line 56 to the top portion of a second blow tank 60 which is maintained at about atmospheric pressure. A restrictive valve 62 is interposed in the second blow line 56 between the first blow tank 26 and the second blow tank 60 for regulating the flow of pulp mixture to the second blow tank 60.

The top portion 58 of the illustrated blow tank 60 comprises a vortex separator of conventional design such that suspended pulp and liquor particles are separated from the steam and other vapors. As in the case of the first blow tank 26, the solids and liquor drop to the bottom portion 63 of the blow tank, while the steam is discharged through conduit 64 to a water cooled condenser 66. A bottom drain 68 in the condenser 66 provides means for withdrawing condensibles from the condenser, while non-condensibles are discharged from the top 70 of the condenser 66 and fed through a conduit 72 to the odor control system 46. Alternatively, the conduit 64 may be connected to other portions of the system capable of using low pressure dirty steam, such as for preheating water.

The bottom portion 63 of the second blow tank 60, preferably the lowest point in the bottom portion, is connected by a conduit 74 to a conventional pulp washing system 75.

As desired, a blow line refiner 76 is included in the second blow line 56 between the valve 62 and the second blow tank. Because of the continuous flow of pulp mixture provided by the present development, there is available to the refiner 76 that quantity of pulp mixture suitable for effectively maintaining a refining operation as an added benefit.

In accordance with the method of the present invention, rather than release the pressurized contents of the digester immediately to atmospheric conditions as has been the practice heretofore, the digester contents are forced by gases at an initial pressure greater than about 100 psig through the first blow line 24, including the valve means 28, to the pressurized first blow tank 26. In the preferred embodiment, the pressure in the first blow tank 26 is maintained at between about 30 and 70 psig, and preferably about 40 psig, which is low enough to allow efficient emptying of the digester by means of the pressure difference (about 110:40), yet high enough to provide a source of dirty steam at a useful pressure, i.e. 40 psig. This pressure relationship between the digester and the first blow tank is established in part by the relative volumes of the apparatus, taking into consideration the presence of the pulp, i.e. that volume of the first blow tank which is occupied by pulp at any given time. Thus, the pressure in the first blow tank will be 40 psig, for example, at the commencement of a blow and will equilibrate at about 60–70 psig at the end of the blow partly in response to the change in volume, i.e. level, of pulp in the first blow tank and partly in response to the change in the quantity of steam released into the first blow tank from the pulp. Importantly, it has been found that blowing the digester into a blow tank under these conditions has no noted adverse effect upon the quality of the pulp.

When the digester 20 has been substantially emptied of the pulp mixture, the valve 28 between the digester and the first blow tank (preferably a three-way valve) is switched to vent the remaining gases, which are also initially at about 60 psig, to the condenser 38, where the hot vent gases are used to heat water for use in various parts of the pulping process. Condensed materials from the vent gases may be separated for re-use, sale or disposal. Prior to discharge to the atmosphere, noncondensible gases are treated in the odor control system 46, typically by burning.

At the end of a blow, within the first blow tank 26 there is an initial quantity of steam at an elevated pressure available for immediate distribution to a dirty steam system. In addition, as pulp is withdrawn from the first blow tank for transfer to the second blow tank, the latent heat of the pulp mixture, in conjunction with the reducing pressure due to the reducing volume of pulp in the first blow tank 26, causes the continuous release of steam and other vapors into the first blow tank. This dirty steam is discharged from the first blow tank through the separator 48 (and the secondary separator 55, if necessary) to remove fibers and black liquor which may be suspended in the steam as a result of being blown into the blow tank. The removed fibers and black liquor are returned to the black liquor system for recirculation or separation. The pressure regulating valve 54 in the outlet conduit 50 controls the release of the dirty steam from the first blow tank to maintain a relatively constant pressure within the blow tank preferably about 40 psig. That is, the valve 54 is set to permit steam to flow from the first blow tank into the conduit 50 so long as the pressure within the blow tank is above about 40 psig.

At all times there is at least about 40 psig in the first tank 26. As noted above, the pressure is controlled by the valve 54. In addition, the valve 62 controls the outflow of pulp to insure the maintenance of pressure. In one embodiment, pulp mixture flows directly from the first blow tank into the second blow tank 60 at a level above the surface of pulp mixture contained in the second blow tank. Alternatively, because the flow of pulp mixture in the second blow line 56 is continuous, this pulp mixture may be refined by the blow line refiner 76 after passage through the valve 62.

The pressure within the second blow tank 60 is atmospheric, so that the pressure drop from about 40 psig to atmospheric (0 psig) serves to "blow" the pulp a second time, with results similar to those of the first blow. The fiber bundles are further separated and steam and other vapors continue to be released as the pulp mixture re-equilibrates. The atmospheric steam and other vapors are passed through the separator 58 to remove fibers and black liquor suspended by the blow. The steam and other vapors are then used for heating purposes and condensed. Noncondensibles are treated by the odor control system 46 (typically by burning) prior to discharge to the atmosphere. The pulp mixture passes from the bottom of the second blow tank 60 through the conduit 74 to a conventional washing system 75 where the fibers are separated from the black liquor. Then the fibers may be processed further, such as by a refiner. The black liquor is then distilled or otherwise treated to prepare it for reuse and to remove valuable extracts.

EXAMPLE

A pilot-scale pressurized blow tank was constructed and installed on the blow line of a pilot digester. Four sets of cooks were made using a 90-minute "to" and 60-minute "on" 110 p.s.i.g. cycle and a 3.0 liquor-to-wood ratio. These cooks were blown under the following sequences: (1) blown from digester at 110 p.s.i.g. to blow tank initially at 40 p.s.i.g., blow tank isolated and its pressure reduced as rapidly as possible to atmospheric, blow tank opened and pulp removed; (2) same as (1) but after equilibrium, blow tank isolated and its pressure reduced as rapidly as possible to 40 p.s.i.g. and pulp blown from 40 p.s.i.g. to atmospheric; (3) same as (2) but isolated blow tank with pulp was maintained at 40 p.s.i.g. for one hour and then reduced rapidly to atmospheric and the pulp removed: (4) blown conventionally from 110 p.s.i.g. into the diffuser at atmospheric. One pulp from each sequence was submitted for physical testing. Cooking conditions and results are summarized in the table below. Properties that differ significantly from those of the control are underlined. Although tear of pulp from sequence (3) is significantly lower, folding endurance and mullen were retained which suggest the possibility of error in the tear test.

| Blow sequence | 1 | 2 | 3 | 4 |
|---|---|---|---|---|
| Active $Na_2O$, % on o.d. wood | 18.2 | 18.0 | 18.2 | 18.9 |
| Kappa number | 33.4 | 32.4 | 31.6 | 32.6 |
| Screenings, % of total pulp | 6.4 | 1.0 | 1.0 | 2.2 |
| C.S.F. | | | | |
| Power factor, kg.-min./cc. 500 | 1.03 | 1.05 | 1.03 | 1.00 |
| Wet web, g./30 mm. at 20% consistency 500 | 207 | 220 | 216 | 188 |
| STANDARD TAPPI HANDSHEETS (500 C.S. freeness) | | | | |
| Basis wt., lb./25×40–500 | 42.8 | 41.7 | 41.7 | 41.6 |
| Caliper, 0.001 inch | 3.7 | 3.7 | 3.7 | 3.7 |
| Mullen, %, pt./lb. | 128 | 136 | 136 | 139 |
| Tear factor | 145 | 150 | 136 | 164 |
| Tensile, lb./1-in. width | 32.9 | 32.0 | 30.0 | 31.3 |
| Sheffield porosity, units/sq. in. | 359 | 551 | 363 | 398 |
| Sheffield smoothness, units | 211 | 251 | 236 | 228 |
| M.I.T. fold, counts | 689 | 609 | 725 | 737 |

Application of the above-described invention has allowed recovery in pressurized dirty steam of about one-third of the energy available in the blow from the digester. Another one-third is contained in the remaining gases which travel from the digester to the first condenser and the last one-third is contained in the pulp mixture passing into the second blow tank, where more energy is recovered in the form of atmospheric steam.

The method and apparatus have been tested to determine the effects upon fiber quality. The results, shown in Table 1, indicate that there is no significant difference between the quality of fibers produced through use of the present invention and those of prior art systems.

In addition, the required capacities of the condensers and odor control equipment are reduced significantly over the prior requirements for these elements because of the distribution of the flow over time and the recirculation, rather than removal, of some of the vapors.

In one embodiment of the method, following the blow of a first batch digester and before the first blow tank is emptied, a further batch digester load may be discharged into the first blow tank. In this situation, as in other embodiments, the steam is discharged from the pressurized blow tank at a rate which, in combination with the rate of discharge of pulp mixture from the first blow tank, maintains the pressure within the first blow tank relatively constant and substantially greater than atmospheric pressure.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. A method of processing cooked pulp in a batch system including a plurality of pressurized batch digesters comprising the steps of discharging a cooked pulp mixture including fibers and black liquor from each of said pressurized batch digesters sequentially into a first blow tank maintained at a substantially constant elevated pressure substantially less than that of said digester and substantially greater than atmospheric until substantially all of the pulp mixture is discharged from said digester thereby maintaining a quantity of pulp within said first blow tank, controllably discharging said pulp mixture in a noninterrupted flow stream from said first blow tank at a location below the surface of said pulp within said first blow tank at a substantially constant rate from said first blow tank into a second blow tank maintained at approximately atmospheric pressure while simultaneously discharging pressurized steam from said first blow tank at a rate which, in combination with the rate of discharge of said pulp mixture from said first blow tank, maintains the pressure within said first blow tank relatively constant and substantially greater than atmospheric pressure and, refining said pulp at a location intermediate said first and second blow tanks.

2. The method described in claim 1 including the steps of condensing steam remaining in said digester following the discharge of pulp and liquor therefrom, separating said pressurized steam and other vapors discharged from said first blow tank from suspended fibers and liquid, using said separated pressurized steam and other vapors for heating, and condensing steam and other vapors from said pulp mixture in said second blow tank.

3. The method described in claim 1 and including the steps of venting steam and other vapors from said second blow tank to atmospheric pressure and removing said pulp mixture from second blow tank.

4. An apparatus for producing wood pulp and recovering steam and other vapors including a plurality of batch digesters, each including means defining a bottom outlet thereof, a pressurized first blow tank including means defining an inlet therein, means defining a top outlet therefrom and means defining a bottom outlet therefrom, means maintaining the internal pressure of said first blow tank at a pressure substantially greater than atmospheric pressure through regulation of the discharge of steam and pulp from said pressurized pulp blow tank while maintaining a quantity of pulp within said first blow tank and while maintaining the flow of pulp from said pressurized blow tank continuous and noninterrupted, said means maintaining said internal pressure of said first blow tank including valve means associated with said means defining a top outlet from said first blow tank and valve means associated with said means defining a bottom outlet from said first blow tank, a first blow line connecting said bottom outlet of each of said digesters to said first blow tank inlet, a second blow tank at atmospheric pressure including means defining an inlet therein, means defining a top outlet therefrom and means defining a bottom outlet therefrom, a second blow line connecting said first blow tank bottom outlet and said second blow tank inlet and, refiner means interposed in said second blow line.

5. An apparatus as described in claim 4 wherein said first blow line valve has a first outlet connected to said first blow tank inlet and a second mutually exclusive outlet connected to condenser means.

6. An apparatus as described in claim 4 and including means defining a dirty steam system connected to said first blow tank top outlet.

7. An apparatus as described in claim 4 and including separator means connected to said second blow tank top outlet, and condenser means connected in flow communication to said separator means and downstream thereof.

8. An apparatus as described in claim 7 and including an odor control means connected to said condenser means.

* * * * *